US007997358B2

(12) United States Patent
Izaguirre et al.

(10) Patent No.: US 7,997,358 B2
(45) Date of Patent: Aug. 16, 2011

(54) BONDING OF CUTTERS IN DIAMOND DRILL BITS

(75) Inventors: Saul N Izaguirre, Spring, TX (US); Thomas W. Oldham, Georgetown, TX (US); Kumar T Kembaiyan, The Woodlands, TX (US); Gary Chunn, Conroe, TX (US); Anthony Griffo, The Woodlands, TX (US); Robert Denton, Pearland, TX (US); Brian A White, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 12/582,212

(22) Filed: Oct. 20, 2009

(65) Prior Publication Data

US 2010/0101868 A1 Apr. 29, 2010

Related U.S. Application Data

(62) Division of application No. 10/455,217, filed on Jun. 5, 2003, now Pat. No. 7,625,521.

(51) Int. Cl.
*E21B 10/46* (2006.01)

(52) U.S. Cl. ..... 175/374; 175/435

(58) Field of Classification Search ..... 175/374, 175/434, 435

See application file for complete search history.

(56) References Cited

U.S. PATENT DOCUMENTS

| | | | |
|---|---|---|---|
| 3,471,921 | A | 10/1969 | Feenstra |
| 3,565,247 | A | 2/1971 | Brochman |
| 3,615,992 | A | 10/1971 | Jeffries et al. |
| 3,757,879 | A | 9/1973 | Wilder et al. |
| 4,351,401 | A | 9/1982 | Fielder |
| 4,499,795 | A | 2/1985 | Radtke |
| 4,682,987 | A | 7/1987 | Brady et al. |
| 4,694,919 | A | 9/1987 | Barr |
| 4,720,371 | A | 1/1988 | Shirley |
| 4,726,432 | A | 2/1988 | Scott et al. |
| 4,947,945 | A | 8/1990 | Griffin |

(Continued)

FOREIGN PATENT DOCUMENTS

| | | |
|---|---|---|
| JP | 02-091141 | 3/1990 |

(Continued)

OTHER PUBLICATIONS

Machine translation of JP 05-093206.

(Continued)

*Primary Examiner* — William P Neuder

(57) ABSTRACT

A bit body formed of a mixture of matrix material and superabrasive powder and including pockets lined with superabrasive-free matrix material, and a method for forming the same, are provided. The pockets are shaped to receive cutting elements therein. The superabrasive-free matrix material enhances braze strength when a cutting element is brazed to surfaces of the pocket. The method for forming the drill bit body includes providing a mold and displacements. The displacements are coated with a mixture of superabrasive free matrix-material and an organic binder. The mold is packed with a mixture of matrix material and superabrasive powder and the arrangement heated to form a solid drill bit body. When the solid bit body is removed from the mold, pockets are formed by the displacements in the bit body and are lined with the layer of superabrasive-free matrix material. The superabrasive material may be diamond, polycrystalline cubic boron nitride, SiC or $TiB_2$ in exemplary embodiments.

33 Claims, 3 Drawing Sheets

U.S. PATENT DOCUMENTS

| | | | | |
|---|---|---|---|---|
| 4,949,598 | A | 8/1990 | Griffin | |
| 4,956,012 | A | 9/1990 | Jacobs et al. | |
| 5,090,491 | A | 2/1992 | Tibbitts et al. | |
| 5,099,935 | A | 3/1992 | Anthon et al. | |
| 5,178,222 | A | 1/1993 | Jones et al. | |
| 5,217,081 | A | 6/1993 | Waldenstrom et al. | |
| 5,348,108 | A | 9/1994 | Scott et al. | |
| 5,370,195 | A | 12/1994 | Keshavan et al. | |
| 5,373,907 | A | 12/1994 | Weaver | |
| 5,433,280 | A | 7/1995 | Smith | |
| 5,441,121 | A | 8/1995 | Tibbitts | |
| 5,500,289 | A | 3/1996 | Gavish | |
| 5,544,550 | A | 8/1996 | Smith | |
| 5,615,747 | A | 4/1997 | Vail, III | |
| 5,679,445 | A | 10/1997 | Massa et al. | |
| 5,737,980 | A | 4/1998 | Keith et al. | |
| 5,765,095 | A | 6/1998 | Flak et al. | |
| 5,829,539 | A | 11/1998 | Newton et al. | |
| 5,839,329 | A | 11/1998 | Smith et al. | |
| 5,957,006 | A | 9/1999 | Smith | |
| 5,967,248 | A | 10/1999 | Drake et al. | |
| 6,073,518 | A | 6/2000 | Chow et al. | |
| 6,135,218 | A | 10/2000 | Deane et al. | |
| 6,148,936 | A | 11/2000 | Evans et al. | |
| 6,170,583 | B1 * | 1/2001 | Boyce | 175/426 |
| 6,200,514 | B1 | 3/2001 | Meister | |
| 6,209,420 | B1 | 4/2001 | Butcher et al. | |
| 6,220,375 | B1 | 4/2001 | Butcher et al. | |
| 6,260,636 | B1 | 7/2001 | Cooley et al. | |
| 6,284,014 | B1 | 9/2001 | Carden | |
| 6,287,360 | B1 | 9/2001 | Kembaiyan et al. | |
| 6,360,832 | B1 | 3/2002 | Overstreet et al. | |
| 6,361,873 | B1 | 3/2002 | Yong et al. | |
| 6,394,202 | B2 | 5/2002 | Truax et al. | |
| 6,454,030 | B1 | 9/2002 | Findley et al. | |
| 6,461,401 | B1 | 10/2002 | Kembaiyan et al. | |
| 6,461,563 | B1 | 10/2002 | Lim et al. | |
| 6,564,884 | B2 | 5/2003 | Bird | |
| 6,615,935 | B2 | 9/2003 | Fang et al. | |
| 6,655,481 | B2 | 12/2003 | Findley et al. | |
| 6,772,849 | B2 | 8/2004 | Oldham et al. | |
| 6,786,288 | B2 | 9/2004 | Singh | |
| 6,845,828 | B2 | 1/2005 | Boyce | |
| 2002/0073803 | A1 | 6/2002 | Narasimhan et al. | |
| 2002/0110474 | A1 | 8/2002 | Sreshta et al. | |
| 2002/0125048 | A1 | 9/2002 | Traux et al. | |
| 2002/0175006 | A1 | 11/2002 | Findley et al. | |
| 2004/0244540 | A1 | 12/2004 | Oldham et al. | |
| 2004/0245022 | A1 | 12/2004 | Izaguirre et al. | |

FOREIGN PATENT DOCUMENTS

| | | |
|---|---|---|
| JP | 05-093206 | 4/1993 |
| JP | 05-148463 | 6/1993 |

OTHER PUBLICATIONS

Abstract of JP 05-148463.
Abstract of JP 02-091141.
CRC Handbook of Chemistry and Physics, 69th Edition. 1988. p. C-353.
Powder Metallurgy Science, German, 2nd edition, 1994, pp. 274-275.

* cited by examiner

BONDING OF CUTTERS IN DIAMOND DRILL BITS

CROSS-REFERENCE TO RELATED APPLICATIONS

This application is a division of co-pending U.S. patent application Serial No. 10/455,217, filed Jun. 5, 2003 which is hereby incorporated by reference in its entirety.

This application is related to co-pending U.S. patent application Ser. No. 10/455,281, entitled "Drill Bit Body with Multiple Binders", filed Jun. 5, 2003, and Ser. No. 10/454,924, entitled "Bit Body Formed of Multiple Matrix Materials and Method for Making the Same", filed Jun. 5, 2003, the contents of each of which are hereby incorporated by reference in their entirety.

BACKGROUND OF THE INVENTION

1. Field of the Invention

The present invention relates, most generally, to an earth boring drill bit that includes cutting elements, and a method for forming the drill bit.

2. Background of the Invention

Various types of drill bits that include cutting elements are used in today=s earth drilling industries. The drill bits typically include cutting elements joined to pockets formed in the drill bit body, by brazing. In many bits, the pockets are formed in blade regions of the bit body. Drill bit bodies are commonly formed of a matrix material such as tungsten carbide. Drill bits are advantageously formed to include the matrix material in combination with a superabrasive material such as diamond crystals, also known as diamond grit. In such case, the matrix material is said to be impregnated with superabrasive material. The drill bit body may be formed to include the superabrasive impregnated matrix material in the blade or other regions of the bit body, or throughout the entire bit body.

GHIs (grit hot-pressed inserts), or PCD (polycrystalline diamond) or PCBN (polycrystalline cubic boron nitride) cutting elements are commonly mounted on the bit body. More particularly, the cutting elements are joined to the pockets or other cavities that extend into the bit body.

A shortcoming of conventional superabrasive impregnated drill bits, and the methods for forming such bits, is that the region of the bit body, for example the blades, that includes the cavities to which the cutting elements are typically joined by brazing, is often formed of superabrasive impregnated matrix material which provides additional hardness and strength to the blades, thereby providing a rock cutting ability to the blades. The presence of superabrasive materials in the impregnated matrix material, however, lowers the braze strength between the cutting elements and the bit body, more particularly, between the cutting element and the cavity to which the cutting element is joined by brazing. If the braze strength is weak, the cutting elements are prone to becoming disengaged from the bit body during drilling, causing early failure of the bit. Therefore, a shortcoming of the conventional art is that, while a superabrasive impregnated region of matrix material provides superior strength and hardness, it reduces braze strength between the drill bit body and the cutting elements. The present invention addresses these shortcomings.

SUMMARY OF THE INVENTION

To address these and other needs, the present invention provides a bit body and a method for forming such a bit body.

In one exemplary embodiment, the method includes providing a mold including a displacement therein and forming a layer of a superabrasive-free first matrix material on the displacement which is used to define a cavity that extends into the bit body. The method further includes introducing a mixture of a second matrix material and superabrasive powder within the mold, and sintering the components to solidify the mixture and the layer.

In another exemplary embodiment, the present invention provides a method for improving the braze strength between a cutting element and a drill bit body. The method includes forming a bit body having at least one region formed of a matrix material impregnated with superabrasive material and forming a pocket extending into the region. The pocket includes an inner surface lined with a layer of a matrix material that is substantially superabrasive-free. The method may further comprise brazing a cutting element to the inner surface of the pocket.

In another exemplary embodiment, the present invention provides a method for forming a bit body including providing a displacement within a mold, coating the displacement with a first material, and forming a second material over the first material and within the mold. The first material has a braze strength greater than the braze strength of the second material.

In another exemplary embodiment, the present invention provides a method for forming a bit body including providing a mold including a displacement therein and forming a layer of first matrix material on the displacement. A second matrix material is introduced within the mold, the second matrix material including a greater concentration of superabrasive powder therein, than the first matrix material. The method further includes sintering the components to solidify the layer and the second matrix material.

In yet another exemplary embodiment, the present invention provides a drill bit body. The drill bit body includes a structural body including a cavity extending inwardly from a surface of the bit body. The cavity is lined with a layer of superabrasive-free matrix material, and a portion of the bit body adjacent the layer of superabrasive-free matrix material is formed of a matrix material impregnated with crystals of superabrasive material.

In another exemplary embodiment, the present invention provides a drill bit body having a structural body including a pocket lined with a liner, and a portion not including the liner. The liner has a braze strength which is greater than a braze strength of the portion not including the liner.

In still another exemplary embodiment, the present invention provides a drill bit body. The drill bit body includes a structural body including a cavity extending inwardly from a surface of the bit body. The cavity is lined with a layer of a first matrix material, and a portion of the bit body adjacent the layer of first matrix material is formed of a second matrix material. The first matrix material includes a lower concentration of superabrasive crystals therein than the second matrix material.

BRIEF DESCRIPTION OF THE DRAWING

The invention is best understood from the following detailed description when read in conjunction with the accompanying drawing. It is emphasized that, according to common practice, the various features of the drawing are not to scale. On the contrary, the dimensions of the various features may be arbitrarily expanded or reduced for clarity. Like numerals denote like features throughout the specification and drawing. Included are the following figures.

DETAILED DESCRIPTION OF THE INVENTION

Figure 1:
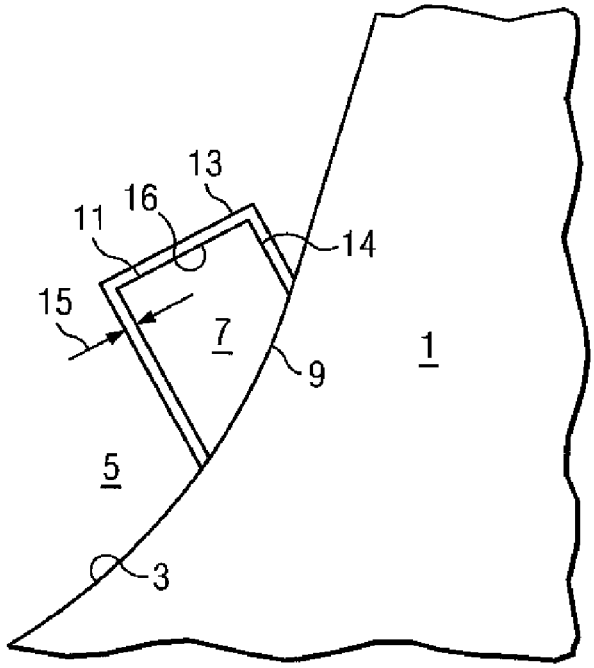
FIG. 1 is a partial, cross-sectional view of a displacement disposed on an inner surface of a mold, and coated with a layer of superabrasive-free matrix material according to an exemplary embodiment of the present invention.

The present invention is directed to a drill bit that includes pockets, holes, indentations or other cavities for receiving any of various cutting elements or inserts, and to a method for forming the same. Hereinafter, the various cavities will be referred to collectively as pockets.

The pockets extend into the bit body and include inner surfaces formed of a material that provides improved braze strength between the pocket and a cutting element brazed to the pocket. In one exemplary embodiment, the pockets are lined with a layer of first material that is surrounded by a second material. The second material includes a higher concentration of superabrasive crystals therein, than the first material. In an exemplary embodiment, the second material includes a 5-50% weight concentration of superabrasive crystals therein, and the layer of first material that lines the pockets may include less than a 1% weight concentration of superabrasive crystals therein. The layer of first material that lines the pockets will desirably include a significantly lower concentration of superabrasive crystals than the adjacent regions of second material that surround the layer of first material. In one exemplary embodiment, the second material with the higher superabrasive crystal concentration may be used in the blade section of a bit body; and, in another exemplary embodiment, the entire bit body may be formed of the second material. The first and second materials may each include a matrix material. The matrix material of the first material and the matrix material of the second material may be the same or they may differ. At least the second matrix material includes superabrasive crystals therein.

Superabrasive materials include diamond, polycrystalline cubic boron nitride (PCBN), silicon carbide (SiC) or titanium diboride ($TiB_2$) may be used in other exemplary embodiments. A superabrasive-free material such as a superabrasive-free matrix material is understood to be a material that is free of all superabrasive materials.

In one exemplary embodiment, the first material is a liner of superabrasive-free matrix material and the second material that is adjacent (e.g., surrounds) the superabrasive-free matrix material liner is formed of a mixture of matrix material and superabrasive crystals (i.e., superabrasive-impregnated matrix material). In an exemplary embodiment, the superabrasive crystals form a powder and may be referred to as a superabrasive powder. In an exemplary embodiment, the mixture may be used in a blade section of the bit body, and in another exemplary embodiment, the entire bit body may be formed of the mixture of matrix material and superabrasive crystals. The matrix material used in the mixture may be the same or it may differ, from the liner of matrix material that is superabrasive-free.

Although the following detailed description is generally directed to the exemplary embodiment in which the pockets are lined with a superabrasive-free matrix material and in which the liner is at least partially surrounded by a mixture of matrix material and superabrasive crystals, the concepts of the invention apply equally to the broader aforementioned embodiment in which the first material has a lower concentration of superabrasive crystals therein, than the adjacent second material which at least partially surrounds the layer of first material.

FIG. 1 is a cross-sectional view showing a section of mold 1 and further illustrates displacement 7 joined to inner surface 3 of mold 1. Displacement 7 extends into interior 5 of mold 1. Displacement 7 produces a pocket in the formed bit body shaped by mold 1. A larger cross-sectional view of an exemplary mold will be shown in FIG. 3. In an exemplary embodiment, mold 1 may be formed of graphite. Other suitable materials may be used in other exemplary embodiments. Displacement 7 may similarly be formed of graphite in an exemplary embodiment, but other materials may be used in other exemplary embodiments. Surface 9 of displacement 7 may be joined to inner surface 3 of mold 1 using various suitable methods. Gluing, taping, or other conventional techniques may be used. In another embodiment, displacement 7 may be integrally formed as part of mold 1 such that surface 9 of displacement 7 is not present. The pocket formed by displacement 7 may take on various shapes configured to receive various cutting elements therein. The illustrated configuration of displacement 7 is intended to be exemplary only. A plurality of displacements 7 may be positioned within mold 1 to produce a corresponding plurality of pockets in the formed drill bit body.

In an exemplary embodiment, displacement 7 is coated with coating 13. More particularly, outer surface 11 of displacement 7 is coated with coating 13. Outer surface 11, in the exemplary embodiment, includes circumferential surface 14 and end surface 16. In one exemplary embodiment, outer surface 11 is completely coated with coating 13. In another exemplary embodiment, only a portion of outer surface 11 is coated with coating 13. In an exemplary embodiment, coating 13 includes a superabrasive-free matrix material. In one exemplary embodiment, the matrix material may be tungsten carbide, but other suitable matrix materials may be used in other exemplary embodiments. In an exemplary embodiment, coating 13 is formed on displacement 7 before displacement 7 is mounted within mold 1.

In an exemplary embodiment, coating 13 comprises a mixture of superabrasive-free matrix material and an organic binder. The binder may be an organic solution consisting of 25% polypropylene carbonate, 45% methyl ethyl ketone (MEK) and 30% propylene carbonate solvent. Other organic binder materials may be used in other exemplary embodiments. For example, organic polymers such as ethylene carbonate, alkaline carbonate, ethylene acrylate co-polymer and polyvinyl alcohol, may be used as the organic binder material.

In one exemplary embodiment, the organic binder solution may be formed by adding 100 grams of an organic solution such as described above, with 750 grams of matrix powder. The mixture may be ball-milled to disperse the matrix powder uniformly throughout the solution. Prior to coating the displacements, excess solution may be evaporated, for example, by using an evaporation-condensation column, in order to thicken the mixture. In one exemplary embodiment, the coating may be applied by dipping the displacement within the organic binder solution on a single occasion, or repeatedly, and in other exemplary embodiments, other methods may be used for applying the organic binder solution to the displacements.

In another exemplary embodiment, coating 13 may be produced by applying tape to displacement 7. The tape may be formed of an organic material and coated with superabrasive-free matrix powder. In another exemplary embodiment, the tape may be formed of a mixture of a suitable organic material in combination with a powder of the superabrasive-free matrix material. According to each of the aforementioned embodiments, the organic material is chosen so that, during subsequent furnacing operations which are used to cement the matrix material with the binder material to form the bit body, the organic material burns off cleanly and evaporates to leave a residue-free, highly-brazeable superabrasive-free layer of material surrounding the displacement. In yet another exemplary embodiment, coating 13 may be formed by a plating operation. Conventional plating techniques may be used to form a residue-free, highly-brazeable superabrasive-free layer which forms coating 13. Other methods for coating the displacements with a superabrasive-free matrix material may be used in other exemplary embodiments.

One or more coating operations may be used to form coating 13. That is, coating 13 may represent multiple layers. In an exemplary embodiment, coating 13 has a thickness 15 in the range of about 0.006 inches to about 0.010 inches. In various exemplary embodiments, coating 13 may additionally include at least one of nickel, tin, phosphorous, or alloys thereof, in addition to the superabrasive-free matrix material.

Figure 2:
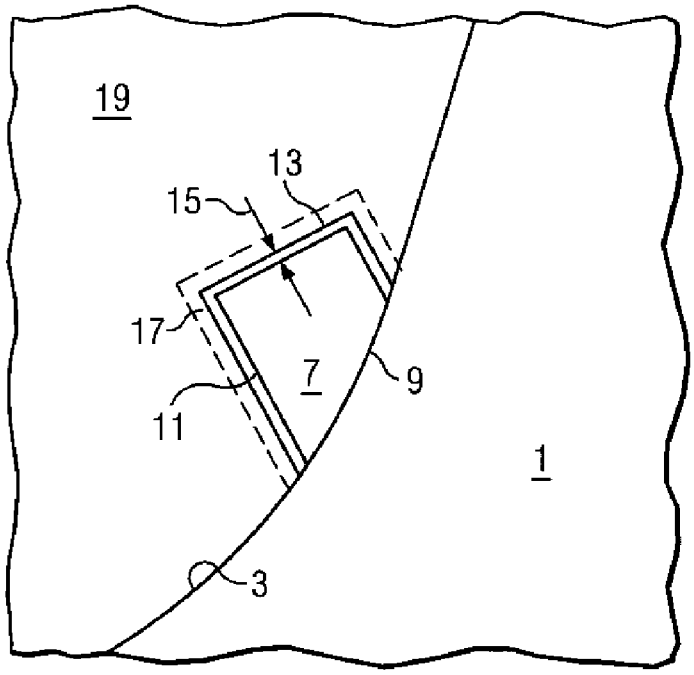
FIG. 2 is a partial, cross-sectional view showing the arrangement of FIG. 1, after additional materials have been introduced into the mold.

Now turning to FIG. 2, when mold 1 is packed with bulk material 19, displacement 7, coated with coating 13, is surrounded by bulk material 19. In one exemplary embodiment, bulk material 19 is a superabrasive-impregnated matrix material, that is, a mixture of matrix material and a powder of superabrasive crystals. In an exemplary embodiment, the superabrasive crystals may be diamond crystals, also referred to as diamond powder. In other exemplary embodiments, other superabrasive crystals such as crystals of superabrasive materials such as polycrystalline cubic boron nitride (PCBN), silicon carbide (SiC) or titanium diboride ($TiB_2$), may be used as the superabrasive powder. In yet another exemplary embodiment, the superabrasive powder may include more than one of the aforementioned superabrasive crystals. In an exemplary embodiment, the matrix material used in the mixture of bulk material 19 may be the same as the superabrasive-free matrix material of coating 13. Tungsten carbide may be a matrix material used in such a capacity. In another exemplary embodiment, the matrix material used in the mixture of bulk material 19 may differ from the matrix material of the superabrasive-free matrix material included in coating 13. The superabrasive-impregnated matrix material may be packed throughout mold 1, or it may be introduced into only portions of mold 1, as will be shown in FIG. 3. A portion of bulk material 19 forms adjacent region 17, bounded by a dashed line, as shown in FIG. 3, to indicate that adjacent region 17 is an arbitrarily delineated portion of bulk material 19 that is adjacent to and surrounding coating 13 of displacement 7.

Figure 3:
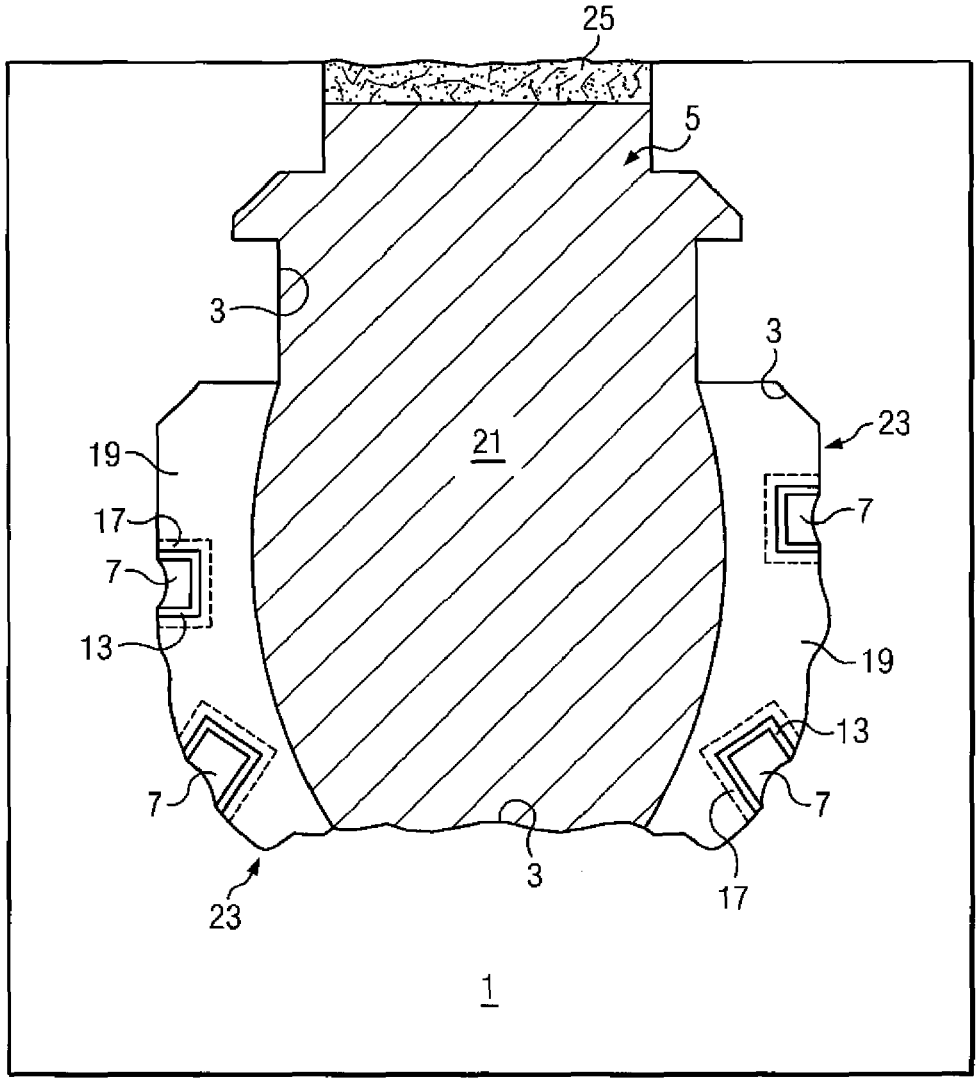
FIG. 3 is a cross-sectional view showing an exemplary mold for forming a drill bit and includes a plurality of displacements within the mold which are coated with superabrasive-free matrix material.

FIG. 3 is a cross-sectional view showing mold 1 packed with bulk material 19 and bulk material 21. Bulk material 19 and bulk material 21 may be used to form the blades and core, respectively, in an exemplary embodiment. In one exemplary embodiment, bulk materials 19 and 21 may be the same material, for example a matrix material such as tungsten carbide mixed with superabrasive powder. In another exemplary embodiment, bulk material 19, used to form blade sections 23, is a superabrasive impregnated matrix material while bulk material 21 includes a superabrasive-free matrix material. Binder material 25 may be added over bulk material 21 prior to sintering. The arrangement shown in FIG. 3 is then sintered and cooled to form a solidified structural bit body. The sintering process also causes binder material 25 to infiltrate bulk materials 21 and 19 and cement bulk materials 21 and 19 with binder materials. Various suitable binder materials 25 are available in the art and conventional sintering processes may be used. During the sintering process, any organic materials in coating 13 are burned off to produce a residue-free layer of superabrasive-free matrix material surrounding pockets formed by displacements 7.

Figure 4:
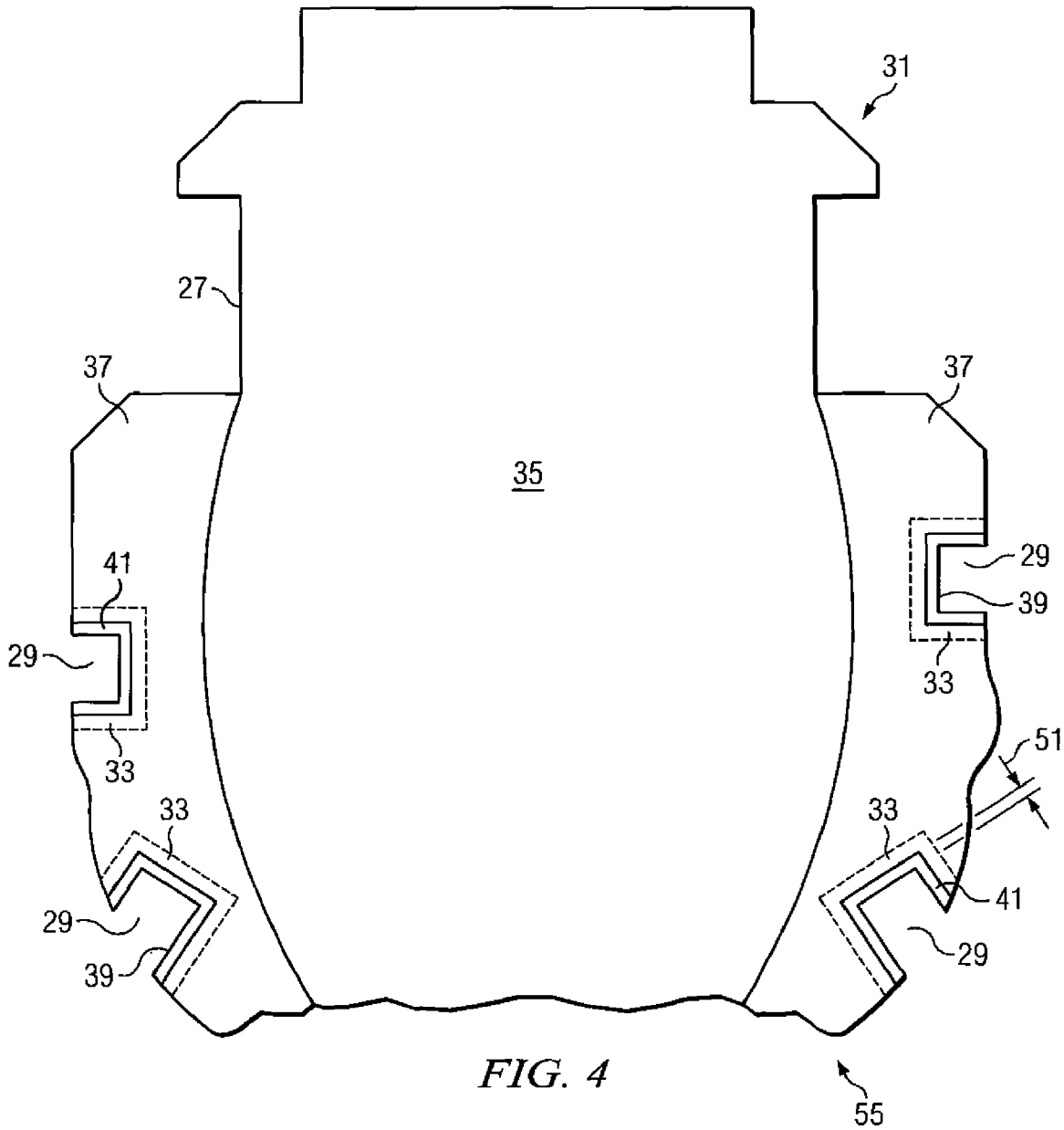
FIG. 4 is a cross-sectional view of an exemplary drill bit formed to include cavities for receiving cutting elements.

After the arrangement shown in FIG. 3 is sintered and cooled, the mold is removed defining an exemplary drill bit body such as shown in FIG. 4. Drill bit body 31 includes surfaces 27, which include various contours and are shaped by corresponding inner surfaces 3 of mold 1. Drill bit body 31 also includes pockets 29 which extend inwardly into drill bit body 31, from surfaces 27 and which are formed by corresponding displacements 7, which are shown in FIG. 3. Pockets 29 are lined with liner 41 which may be a layer of superabrasive-free matrix material formed from coating 13 (shown in FIG. 1). Liner 41 forms pocket inner surface 39. Pockets 29 are each shaped to receive a cutting element or insert that will be brazed to pocket inner surface 39. Liners 41 are each bounded by adjacent region 33 in the illustrated embodiment. Adjacent regions 33 are the portions of bit body material 37 that are adjacent, i.e., surround, the superabrasive-free matrix material of liner 41. Bit body material 37, including adjacent region 33, is formed of a mixture of matrix material and superabrasive powder. In an exemplary embodiment, bit body material 37 may include a weight percentage of superabrasive crystals ranging from 5 to 50%. Drill bit body 31 also includes further bit body material 35. In one exemplary embodiment, both bit body material 37 and further bit body material 35 are formed of the mixture of matrix material and superabrasive powder. In another exemplary embodiment, drill bit body 31 may be tailored to include portions, such as blades 55, formed of bit body material 37 which is a superabrasive impregnated matrix material, and further bit body material 35, which is formed of a non-impregnated matrix material. The matrix materials in the layer of superabrasive-free matrix material 41, and in bit body material 37 of the formed drill bit body 31, may be the same or they may differ.

In an exemplary embodiment, liner 41 has a thickness 51, which may range from about 0.001 inches to about 0.5 inches, more preferably from about 0.004 inches to about 0.2 inches, and more preferably still, from 0.006 inches to about 0.01 inches. Different thickness may be used in other exemplary embodiments.

Cutting elements or inserts are then inserted within pockets 29 and secured into position by brazing. The cutting elements may be PCD cutting elements, PCBN cutting elements, or grit hot-pressed inserts. Such exemplary cutting elements/inserts are hereinafter referred to collectively as cutting elements. The cutting elements include a substrate portion that is brazed to pocket inner surface 39. According to either exemplary embodiment, the braze strength between the cutting element and pocket 29 is enhanced since pocket inner surface 39 is superabrasive-free. A superior braze strength is achieved when either a superabrasive-free or superabrasive impregnated surface is brazed to pocket inner surface 39.

Various braze alloys may be used in the brazing process. In an exemplary embodiment, silver-containing braze alloys such as commercially available BAg7 may be used. Such is intended to be exemplary only and other braze alloys that may contain silver in combination with copper, zinc, tin or other elements may be used to braze the cutting elements to pockets 29, using conventional techniques.

Figure 5:
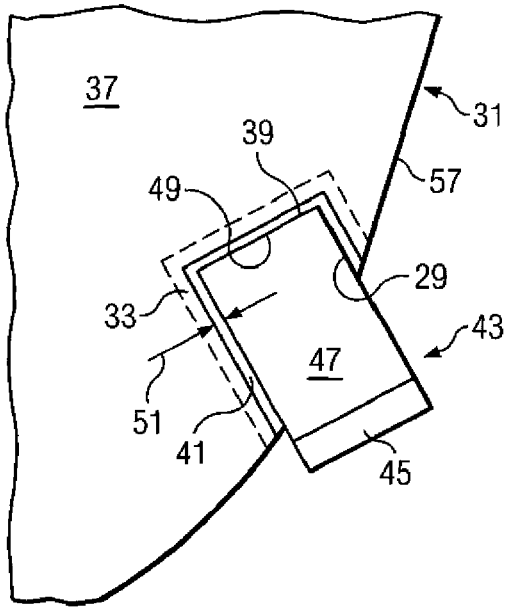
FIG. 5 is a partial, cross-sectional view showing a cutting element joined to a cavity that extends into a bit body formed according to an exemplary embodiment of the present invention.

FIG. 5 is a partial cross-sectional view showing exemplary cutting element 43 joined to drill bit pocket 29. Cutting element 43 includes substrate portion 47 and cutting surface 45 which may be polycrystalline diamond or polycrystalline cubic boron nitride in various exemplary embodiments. In another exemplary embodiment, the cutting element may be a grit hot-pressed insert. Cutting element 43 is received within and joined to pocket 29 of drill bit body 31. More particularly, substrate portion 47 of cutting element 43 is brazed to pocket inner surface 39 of pocket 29. Liner 41, which in the exemplary embodiment is a layer of superabrasive-free matrix material, enhances the braze strength between cutting element 43 and pocket 29 when cutting element 43 is brazed into position within pocket 29 of drill bit body 31. It can be seen that portions of blade surface 57 in close proximity to pocket 29, as well as adjacent region 33, are formed of the mixture of matrix material and superabrasive powder.

According to another exemplary embodiment, coating 13 and adjacent region 17 each include a matrix material, with coating 13 having a significantly lower concentration of superabrasive powder than bulk material 19, which includes adjacent region 17. According to this exemplary embodiment, when the solid bit body is formed after sintering, liner 41 is formed to have a significantly lower concentration of superabrasive crystals therein, than adjacent region 33 and bit body material 37. Liner 41 may be superabrasive-free or it may include superabrasive crystals at a reduced concentration therein. In one exemplary embodiment in which liner 41 does include superabrasive crystals, it may include a superabrasive crystal concentration of less than 1% by weight and which will be significantly less than adjacent region 33, which may include a weight percentage of superabrasive crystals that ranges from 5 to 50%. In this embodiment, the braze strength between a cutting element 43 and pocket 29 is enhanced due to the reduced concentration of superabrasive crystals in liner 41, as compared to in bit body material 37.

The preceding merely illustrates the principles of the invention. It will thus be appreciated that those skilled in the art will be able to devise various arrangements which, although not explicitly described or shown herein, embody the principles of the invention and are included within the scope and spirit. Furthermore, all examples and conditional language recited herein are principally intended expressly to be only for pedagogical purposes and to aid in understanding the principles of the invention and the concepts contributed by the inventors to furthering the art, and are to be construed as being without limitation to such specifically recited examples and conditions. For example, the pockets may be positioned differently and take on various shapes to accommodate the differently shaped cutting elements which they receive. Various cutting elements and inserts may be used. The drill bit body may similarly take on other shapes depending on the intended drilling application.

Moreover, all statements herein reciting principles, aspects, and embodiments of the invention, as well as specific examples thereof, are intended to encompass both structural and the functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of the present invention is embodied by the appended claims.

What is claimed is:

1. A drill bit comprising:

a bit body including at least one cavity extending inwardly from a surface thereof, the cavity bounded by a cavity surface at least a portion of which is formed of a layer of substantially superabrasive-free first matrix material and a portion of the bit body adjacent the layer is formed of a second matrix material impregnated with superabrasive crystals; and a cutting element brazed to the cavity surface using a braze alloy.

2. The drill bit as in claim 1, wherein the layer further includes at least one of nickel, tin, phosphorus, and alloys thereof.

3. The drill bit as in claim 1, wherein the layer has a thickness within a range of about 0.001 inch to 0.2 inch.

4. The drill bit as in claim 1, wherein the bit body includes at least one blade, the at least one cavity formed within the blade, and wherein the blade comprises the second matrix material impregnated with superabrasive crystals.

5. The drill bit as in claim 4, wherein the bit body further includes a superabrasive-free third matrix material positioned interior of and adjacent to the second matrix material.

6. The drill bit as in claim 1, wherein the braze alloy contains silver.

7. The drill bit as in claim 1, wherein the layer is completely superabrasive-free.

8. The drill bit as in claim 1, wherein the superabrasive crystals comprise diamond crystals.

9. The drill bit as in claim 1, wherein the first and second matrix materials are the same.

10. The drill bit as in claim 1, wherein the first and second matrix materials are different.

11. The drill bit as in claim 1, wherein the cutting element is a polycrystalline diamond cutting element.

12. The drill bit as in claim 1, wherein the first matrix material comprises a metal carbide.

13. The drill bit as in claim 12, wherein the second matrix material comprises a metal carbide.

14. The drill bit as in claim 1, wherein the first matrix material comprises tungsten carbide.

15. The drill bit as in claim 14, wherein the second matrix material comprises tungsten carbide.

16. A drill bit body comprising:

a bit body including at least one cavity extending inwardly from a surface thereof, the cavity bounded by a cavity surface at least a portion of which is formed of a layer of a first matrix material having a first braze strength and a portion of the bit body adjacent the layer is formed of a second matrix material impregnated with superabrasive crystals having a second braze strength less than the first braze strength of the first matrix material, wherein the first matrix material comprises less than 1 percent by weight of superabrasive crystals and the second matrix material comprises 5 to 50 percent by weight of superabrasive crystals; and a cutting element brazed to the cavity surface using a braze alloy.

17. The drill bit as in claim 16, wherein the layer further includes at least one of nickel, tin, phosphorus, and alloys thereof.

18. The drill bit as in claim 16, wherein the layer has a thickness within a range of about 0.001 inch to 0.2 inch.

19. The drill bit as in claim 16, wherein the bit body includes at least one blade, the at least one cavity formed within the blade, and wherein the blade comprises the second matrix material impregnated with superabrasive crystals.

20. The drill bit as in claim 19, wherein the bit body further includes a superabrasive-free third matrix material positioned interior of and adjacent to the second matrix material.

21. The drill bit as in claim 16, wherein the braze alloy contains silver.

22. The drill bit as in claim 16, wherein the layer is completely superabrasive-free.

23. The drill bit as in claim 16, wherein the superabrasive crystals comprise diamond crystals.

24. The drill bit as in claim 16, wherein the first and second matrix materials are the same.

25. The drill bit as in claim 16, wherein the first and second matrix materials are different.

26. The drill bit as in claim 16, wherein the cutting element is a polycrystalline diamond cutting element.

27. The drill bit as in claim 16, wherein the first matrix material comprises a metal carbide.

28. The drill bit as in claim 27, wherein the second matrix material comprises a metal carbide.

29. The drill bit as in claim 16, wherein the first matrix material comprises tungsten carbide.

30. The drill bit as in claim 29, wherein the second matrix material comprises tungsten carbide.

31. A drill bit comprising:

a bit body prepared by:

providing a mold including a displacement therein;

forming a layer of a first matrix material on the displacement, the first matrix material comprising less than 1 percent by weight of superabrasive crystals;

introducing a mixture of a second matrix material within the mold adjacent the layer of the first matrix material, the second matrix material comprising superabrasive crystals in a greater concentration than the first matrix material;

sintering to solidify the mixture and the layer in the mold to form the bit body comprising at least a portion formed from the second matrix material impregnated with superabrasive crystals adjacent the layer formed from the first matrix material, and a cavity defined by the displacement in the bit body.

32. The drill bit as in claim 31, wherein the drill bit further comprises a cutting element brazed within the cavity using a braze alloy.

33. The drill bit as in claim 31, wherein the layer is completely superabrasive-free.

* * * * *